US005370158A

United States Patent [19]

Ogata et al.

[11] Patent Number: 5,370,158

[45] Date of Patent: Dec. 6, 1994

[54] WEFT WINDER FOR WEAVING MACHINE HAVING MAGNETS WITH DIFFERENT SURFACE FLUX DENSITY

[75] Inventors: Masao Ogata, Honjyo; Nobuo Kakinuma, Hanyu, both of Japan

[73] Assignee: Hitachi Metals, Ltd., Tokyo, Japan

[21] Appl. No.: 92,436

[22] Filed: Jul. 14, 1993

[30] Foreign Application Priority Data

Jul. 15, 1992 [JP] Japan ..... 4-187993

[51] Int. Cl.[5] ..... D03D 47/34

[52] U.S. Cl. ..... 139/452

[58] Field of Search ..... 139/452; 242/47.01

[56] References Cited

U.S. PATENT DOCUMENTS

| | | | |
|---|---|---|---|
| 4,498,639 | 2/1985 | Deborde et al. | 139/452 X |
| 4,744,394 | 5/1988 | Lincke | 139/452 |
| 4,747,549 | 5/1988 | Bulzarotti | 242/47.01 X |
| 4,850,401 | 7/1989 | Hamer | 139/452 |
| 5,046,536 | 9/1991 | Zenonic | 139/452 |
| 5,094,275 | 3/1992 | Shaw et al. | 139/452 |

FOREIGN PATENT DOCUMENTS

| | | |
|---|---|---|
| 61-142887 | 9/1986 | Japan . |
| 187183 | 6/1989 | Japan . |

*Primary Examiner*—Andrew M. Falik
*Attorney, Agent, or Firm*—Sughrue, Mion, Zinn, Macpeak & Seas

[57] ABSTRACT

The weft winder for a weaving machine has (a) a non-magnetic, hollow-cylindrical outer frame member having an inner conical surface at one end thereof; (b) a rotor disposed rotatably and concentrically with the outer frame member, which is only rotatable; (c) a non-magnetic, inner frame member rotatably supported by the rotor and having an outer conical surface facing the inner conical surface of the outer frame member via a gap therebetween; (d) a pipe projecting from an outer end of the rotor and extending in the gap for guiding a weft; and (e) a plurality of magnet members each constituted by a plate-shaped magnet and a yoke and fixed to the inner conical surface and the outer conical surface, respectively, such that N poles and S poles of the magnets are circumferentially arranged alternately and that different magnetic poles of the magnet members are opposing each other via the gap. The magnet in each magnet member is magnetized in a thickness direction such that a magnetic pole on a front surface facing the gap has a larger magnetic flux density than that of a magnetic pole on a rear surface.

5 Claims, 3 Drawing Sheets

WEFT WINDER FOR WEAVING MACHINE HAVING MAGNETS WITH DIFFERENT SURFACE FLUX DENSITY

BACKGROUND OF THE INVENTION

The present invention relates to an improved weft winder of a weaving machine for winding and supplying a weft to warp in the weaving process.

The weft winder for a weaving machine generally has a structure as shown in FIG. 6. The weft winder comprises an outer frame member 1 constituted by a hollow cylinder made of aluminum alloys, etc. and having an inner conical surface 2 at one end, a rotor 3 having a pipe 4 projecting from one end thereof for guiding a weft 5 and disposed in the outer frame member 1 such that it is concentrically rotatable, and an inner frame member 6 made of aluminum alloys etc. and rotatably supported by the rotor 3 via bearings 7 concentrically with the rotor 3. The inner frame member 6 is provided at a free end (inner end) thereof with an outer conical surface 8 facing the inner conical surface 2 of the outer frame member 1 via a gap G therebetween, and the pipe 4 of the rotor 3 extends through the gap G. The inner frame member 6 has a weft-winding portion 9 for winding the weft 5 supplied from the pipe 4 at the outer end.

FIG. 7 shows the details of a portion A in FIG. 6. In FIG. 7, the same members are assigned the same reference numerals as in FIG. 6. The inner conical surface 2 of the outer frame member 1 and the outer conical surface 8 of the inner frame member 6 are each provided with a plurality of magnet members 10 each constituted by a plate-shaped magnet 10*a* a and a yoke 10*b*. Each magnet 10*a* is magnetized in a thickness direction, and a plurality of magnets 10*a* are arranged in a circumferential direction such that N poles and S poles are arranged alternately. Also, the magnets 10*a* on the inner conical surface 2 and the magnets 10*a* on the outer conical surface 8 are opposite each other with their different magnetic poles facing each other. Incidentally, the plate-shaped magnet 10*a* is preferably in the shape of a disc, and the yoke 10*b* is preferably constituted by an iron plate formed substantially in the shape of a bowl. The magnet 10*a* is fixed to the yoke 10*b*, which is in turn fixed to each of recesses formed in the inner conical surface 2 and the outer conical surface 8 via a bolt 11.

With the above construction, the rotor 3 can be rotated with a gap G between the inner conical surface 2 of the outer frame member 1 and the outer conical surface 8 of the inner frame member 6 kept constant due to a magnetic attraction of the magnet members 10, 10. Thus, the weft 5 guided through the pipe 4 can be wound around the weft-winding portion 9 of the inner frame member 6.

In the weft winder for a weaving machine having the above construction, however, there should be a large number of magnet members 10 in order to keep the inner frame member 6 stationary relative to the outer frame member 1 with a gap G between the inner conical surface 2 and the outer conical surface 8 kept at a constant distance. For instance, with the magnet members 10 each having a diameter of 21 mm, 24 magnet members are arranged. This leads to a close distance between the adjacent magnet members 10, 10 on the inner conical surface 2 and the outer conical surface 8, making it likely to have a short circuit of magnetic flux between the adjacent magnet members 10, 10. This in turn leads to the reduction of a magnetic attraction between the opposing magnet members 10 and 10.

For the purpose of increasing a magnetic attraction, it may be considered to reduce the gap G between the inner conical surface 2 and the outer conical surface 8. However, this is impossible because the pipe 4 usually rotating at a high speed of 2,000–2,500 rpm is vibrated to some extent. On the other hand, since part of the yoke 10*b* extends outside the magnet 10*a*, a short-circuiting of the magnetic flux would also take place in the extended yoke portions. Therefore, a large number of strong magnet 10*a* should be used, which would lead to a large weight and high cost of the weft winder.

Japanese Utility Model Laid-Open No. 61-142887 discloses a weft winder for a fluid jet-type weaving machine which comprises magnets contained in magnetic capsules which are fixed to inner surfaces of U-shaped magnetic yokes in order to maximize the magnetic attraction of magnets. However, this magnet members has a complicated structure and is not necessarily sufficient in terms of magnetic attraction between the opposing magnet members.

To solve the above problem, an improved weft winder for a weaving machine was previously proposed by Japanese Utility Model Laid-Open No. 1-87183. This weft winder has a structure in which each magnet is lined with a yoke such as an iron plate and fixed to each of the inner conical surface of the outer frame member and the outer conical surface of the inner frame member by bolts. By this structure, this weft winder shows sufficient magnetic attraction between the opposing magnet members with smaller numbers of magnet members than those of the conventional ones. However, further improvement is desired to meet increasingly higher demands of performance and cost.

OBJECT AND SUMMARY OF THE INVENTION

Accordingly, it is an object of the present invention to provide a weft winder for a weaving machine having a smaller number of magnets capable of providing sufficient magnetic attraction by utilizing the magnetic flux of each magnet efficiently.

In order to achieve the above-stated object, the present invention provides a weft winder for a weaving machine comprising (a) an outer frame member constituted by a hollow cylinder made of a non-magnetic material and having an inner conical surface at one end thereof; (b) a rotor disposed rotatably and concentrically with the outer frame member; (c) an inner frame member made of a non-magnetic material and rotatably supported by the rotor, the inner frame member having an outer conical surface facing the inner conical surface of the outer frame member via a gap therebetween; (d) a pipe projecting from an outer end of the rotor and extending in the gap for guiding a weft; and (e) a plurality of magnet members fixed to the inner conical surface and the outer conical surface, respectively, such that N poles and S poles are circumferentially arranged alternately and that between the magnet members opposing via the gap different magnetic poles are opposing each other, wherein only the rotor is rotatable, wherein each magnet member comprises a plate-shaped magnet magnetized in a thickness direction such that a magnetic pole on a front surface facing the gap has a larger magnetic flux density than that of a magnetic pole on a rear surface, and a plate-shaped yoke made of a ferromagnetic material and having a shape encircling it periphery of the magnet, the magnet being fixed to the yoke.

BRIEF DESCRIPTION OF THE DRAWINGS

FIG. 5(*b*) is a cross-sectional view showing an apparatus for forming a magnet for use in the conventional weft winder;

DETAILED DESCRIPTION OF THE INVENTION

Figure 1:
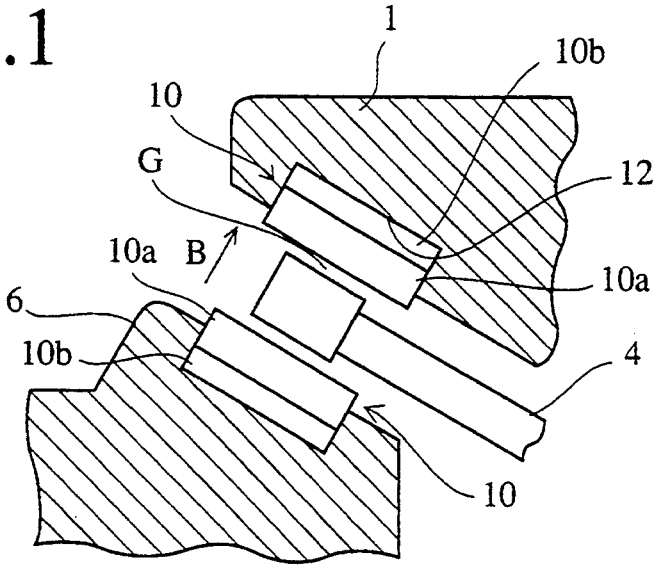
FIG. 1 is an enlarged cross-sectional view showing an important portion of the weft winder according to the present invention.
Figure 2:
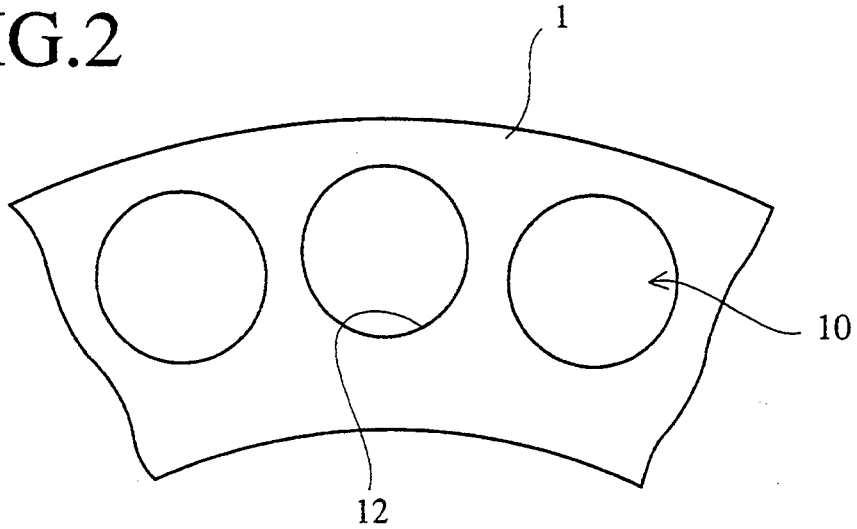
FIG. 2 is a partial view when looked in the direction B.
Figure 7:
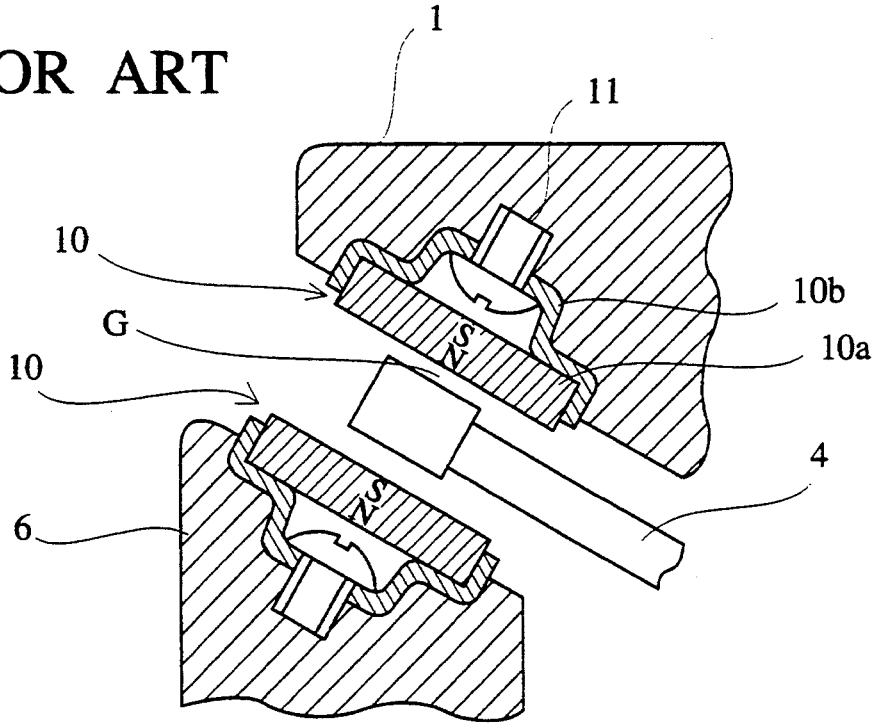
FIG.7 PRIOR ART
FIG. 7 is an enlarged cross-sectional view of a portion A in FIG. 6.

Like FIG. 7, FIG. 1 shows the important portion of the weft winder for a weaving machine according to the present invention, and the same members are assigned the same reference numerals as in FIG. 7. FIG. 2 shows magnet members viewed from B. In FIGS. 1 and 2, each magnet 10*a* is lined with a yoke 10*b* such as a 1-mm-thick iron plate and fixed to each of the inner conical surface 2 of the outer frame member 1 and the outer conical surface 8 of the inner frame member 6. By the yoke 10*b* attached to a rear surface of the magnet 10*a*, the magnetic flux of the magnet 10*a* can be increased. Incidentally, in a typical example, the magnet 10*a* may have a size of 21 mm in diameter and 4.6 mm in thickness, and the yoke 10*b* may have a size off 21 mm in diameter and 1 mm in thickness. According to the inventor's experiment, if the iron plate has a thickness of 1 mm or more, magnetic saturation in the yoke 10*b* can be prevented, thereby making it possible to utilize the magnetic flux of the magnet 10*a* efficiently.

The magnet members 10 each constituted by a magnet 10*a* and a yoke 10*b* are bonded by means of an adhesive to recesses 12 formed at a constant or different interval in a circumferential direction in the inner conical surface 2 and the outer conical surface 8, such that the opposing magnets 10*a* via the gap G have different magnetic poles. Incidentally, the magnet members may be fixed to the recesses 12 by bolts.

Each magnet 10*a* may be made of ferrite magnet materials, but it is preferable to use rare earth magnet materials such as R-Co magnets (U.S. Pat. Nos. 3,655,463, 4,210,471, 4,172,717, etc.) or R-Fe-B magnet materials (U. S. Pat. No. 4,770,723, etc.) having a large maximum energy product.

It is indispensable that a magnetic pole of the magnet 10*a* on a front surface facing the gap G has a larger magnetic flux density than that of a magnetic pole on a rear surface. The magnetic flux density of the magnet 10*a* on a front surface is preferably as large as 1.2 times or more that on a rear surface.

This feature of the magnet can be achieved by using an apparatus shown in FIG. 5(*a*) as mentioned below.

By the above construction, the magnetic flux of the magnet 10*a* would not leak out or be short-circuited, making it possible to keep the inner frame member 6 stationary relative to the outer frame member 1 via a predetermined gap G even with small numbers of the magnet 10*a*, with only the rotor 3 left rotatable. Thus, it is possible to reduce the number of the magnet members 10 drastically as compared to those disclosed by FIG. 7. Also, in comparison with the weft winder of Japanese Utility Model Laid-Open No. 1-87183, the number of the magnet members can be reduced by 10% or more.

Figure 3:
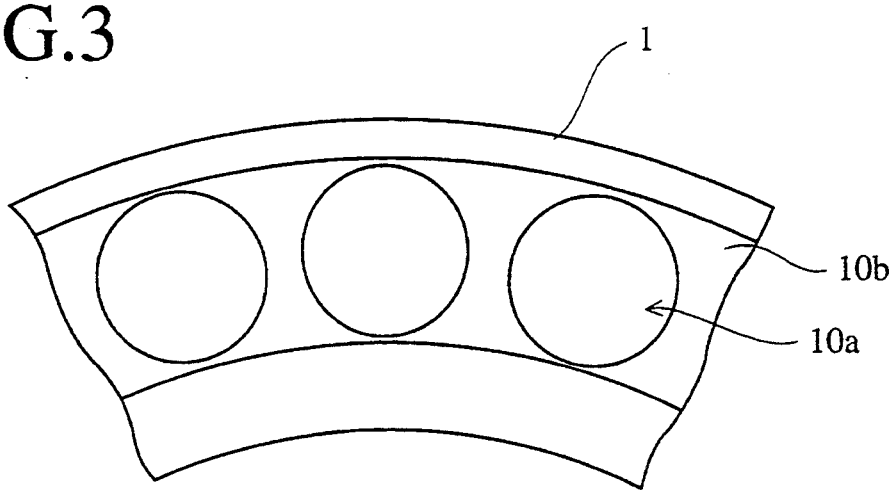
FIG. 3 is a partial view showing magnet members according to another embodiment of the present invention.

FIG. 3 shows another example of the yoke 10*b* according to the present invention. In this example, the yoke 10*b* is constituted by a ring made of a ferromagnetic material such as an iron plate, etc. The ring-shaped yoke 10*b* extends along a circumferential direction on the inner conical surface 2 and the outer conical surface 8. The ring-shaped yoke 10*b* has a width equal to or greater than a diameter of each magnet 10*a*. Each magnet 10*a* is adhered to a surface of the ring-shaped yoke 10*b*. With respect to the fixing of the ring-shaped yoke 10*b* to the outer frame member 1 and the inner frame member 6, it can be done by an adhesive or bolts as in the aforementioned embodiment.

With the above construction, the same effects as above can be expected with easiness in fixing operation of the magnet members 10 to the outer frame member 1 and the inner frame member 6. Incidentally, the yoke 10*b* may be in an arc or short strip shape which makes it possible to fix at least two magnets 10*a* to the yoke 10*b*.

Figure 4:
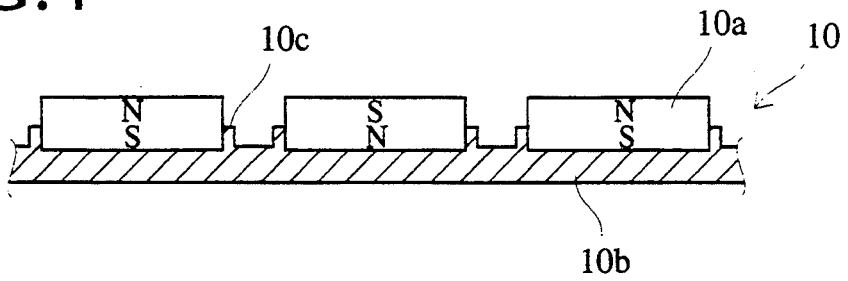
FIG. 4 is a partial cross-sectional view taken along a line extending in a circumferential direction showing magnet members according to a further embodiment of the present invention.

FIG. 4 shows a yoke 10*b* extending in a circumferential direction on the inner conical surface 2 and the outer conical surface 8 for fixedly supporting a plurality of magnets 10*a*. The yoke 10*b* has projections 10*c* for holding each magnet 10*a* in a portion encircled by the adjacent holding projections 10*c*. The yoke 10*b* may be produced from a magnetic material comprising magnetic powder such as iron power and a binder resin such as polyphenylene sulfide resins, polybutylene terephthalate resins, polyamide resins, polyimide resins, polybutylene resins, polyester resins, etc.

The magnet members 10 shown in FIG. 4 can be formed integrally with the magnet 10*a* by placing the magnet 10*a* in advance in a cavity of an injection mold and injecting the above magnetic material into the cavity. As compared with the magnet members 10 comprising an iron plate as a yoke, the structure of FIG. 4 can have a greatly reduced weight.

Figure 5:
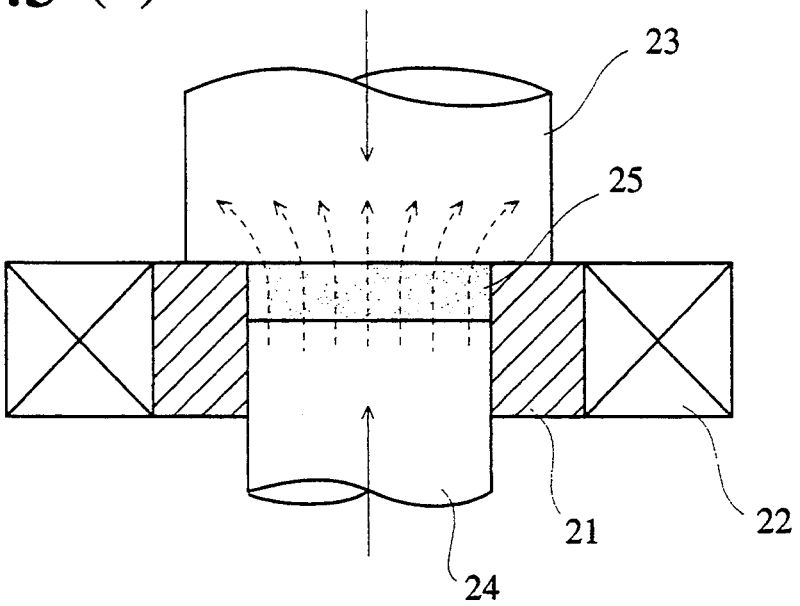
FIG. 5(*a*) is a cross-sectional view showing an apparatus for forming a magnet for use in the weft winder of the present invention.
Figure 5:
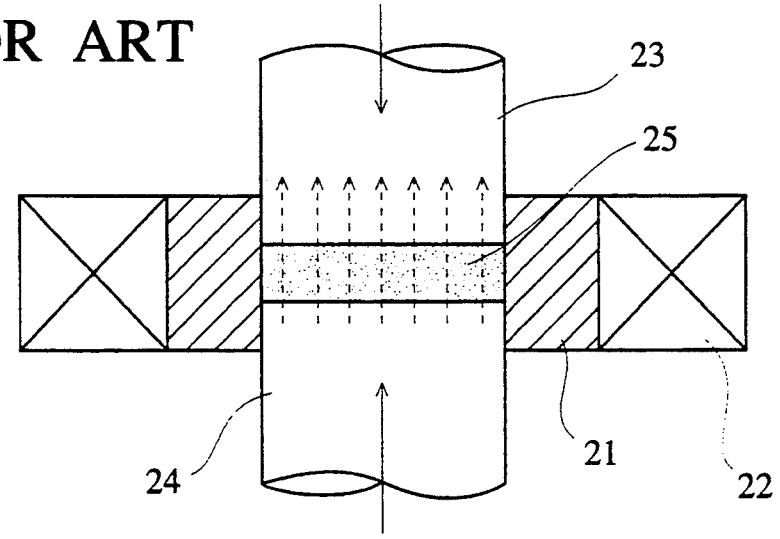
FIG.5 (b) PRIOR ART
Figure 6:
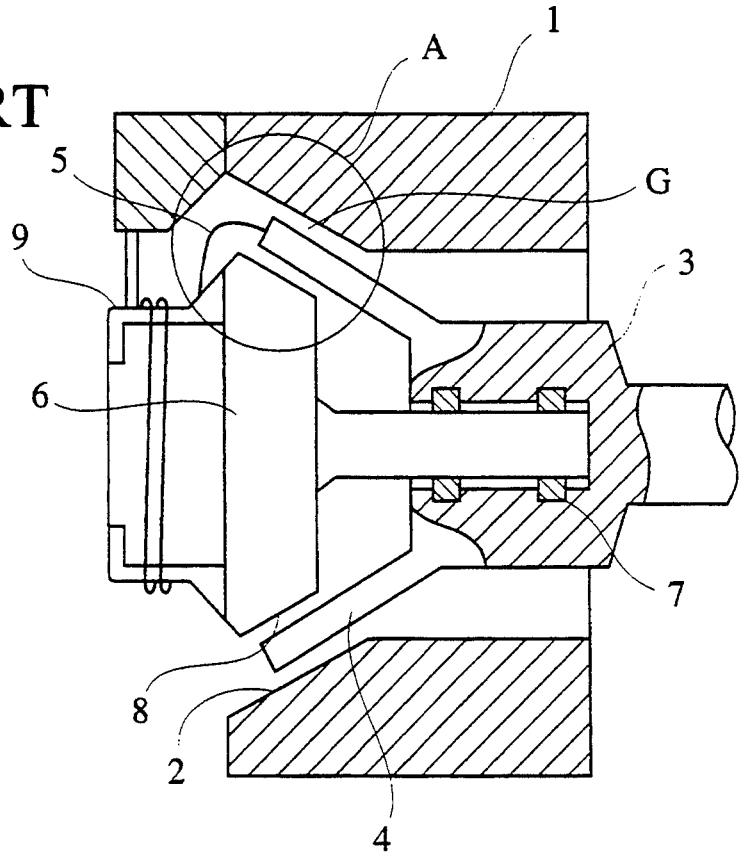
FIG.6 PRIOR ART
FIG. 6 is a cross-sectional view showing a weft winder for a weaving machine to which the present invention is applicable.

FIG. 5(*a*) shows an apparatus for forming the magnet 10*a* for use in the weft winder of the weaving machine according to the present invention. This apparatus comprises a ring-shaped die 21 having a cavity and made of a wear-resistant non-magnetic material such as a cemented carbide, an upper plunger 23 made of a ferromagnetic material such as steel and abutting an upper end of the die 21 for closing an upper end of the cavity of the die 21, a lower plunger 24 made of a ferromagnetic material such as steel and slidable in the cavity of the die 21, and a coil 22 disposed around the die 21 for causing the magnetic orientation of magnet powder.

A magnetic material 25 consisting of magnet powder such as rare earth magnet powder is introduced into the cavity of the die 21 with a lower end of the cavity is closed by the lower plunger 24. After closing the cavity by the upper plunger 23, the magnetic material 25 is compressed by elevating the lower plunger 24. In this case, magnetic orientation can be achieved by energizing the coil 22.

Since the upper plunger 23 simply abuts the upper end of the die 21, magnetic flux passing through the magnet formed in the cavity diverges or expands at an upper end of the magnet as shown in FIG. 5(*a*). Thus, magnetic orientation is slightly lower at an upper end of the magnet than at a lower end of the magnet. Therefore, if the magnet formed by this apparatus is fixed to the outer frame member 1 and the inner frame member 6 such that the above lower end of the magnet corresponds to a front surface facing the gap G, and that the above upper end of the magnet corresponds to a rear surface, then the front surface would show higher magnetic flux density than the rear surface.

On the other hand, when an apparatus shown in FIG. 5(*b*) is used wherein an upper plunger 23 and a lower plunger 24 are both slidable in a cavity of a die 21, the resulting magnet is subjected to substantially parallel magnetic flux, resulting in substantially the same magnetic flux density on both sides of the magnet. Therefore, such magnet cannot be used for the weft winder of a weaving machine according to the present invention.

With the apparatus shown in FIG. 5(*a*), $Sm_2Co_{17}$ type magnets (H-23CV) available from Hitachi Metals, Ltd.) magnetized in a thickness direction were produced, and the magnetic flux density of each magnet was measured on both sides thereof. The results are shown in Table 1.

TABLE 1

| Sample No.* | Magnetic Flux Density (G) | | |
|---|---|---|---|
| | at N Pole | at S Pole | Ratio* |
| 1 | 2050 | 1520 | 1.35 |
| 2 | 2030 | 1650 | 1.23 |
| 3 | 2190 | 1450 | 1.51 |
| 4 | 2090 | 1620 | 1.29 |
| 5 | 2320 | 1440 | 1.61 |
| 6 | 2270 | 1340 | 1.69 |
| 7 | 2150 | 1360 | 1.58 |
| 8 | 2230 | 1350 | 1.65 |
| 9 | 2260 | 1390 | 1.63 |
| 10 | 1490 | 2200 | 1.48 |
| 11 | 1710 | 2090 | 1.22 |
| 12 | 1280 | 2350 | 1.84 |
| 13 | 1670 | 2120 | 1.27 |
| 14 | 1390 | 2350 | 1.69 |
| 15 | 1510 | 2100 | 1.39 |
| 16 | 1410 | 2180 | 1.55 |
| 17 | 1320 | 2200 | 1.67 |
| 18 | 1400 | 2070 | 1.48 |

Note:
*N pole is on a front surface in Sample Nos. 1–9, and S pole is on a front surface in Sample Nos. 10–18.
**Ratio of magnetic flux density on a front surface to magnetic flux density on a rear surface.

As is clear from Table 1, the magnet formed by the apparatus shown in FIG. 5(*a*) shows significant difference in magnetic flux density between the front surface and the rear surface, and the ratio of magnetic flux density on the front surface to that on the rear surface is 1.22–1.84. This ratio can be changed by changing a diameter ratio of the upper plunger 23 to the lower plunger 24. According to the inventor's investigation, the above magnetic flux density ratio is preferably 1.2 or more, more preferably 1.3 or more.

The magnet member 10 comprising the magnet 10*a* produced as mentioned above shows greatly improved magnetic attraction between the opposing magnets disposed on the outer frame member 1 and the inner frame member 6. This means that the same magnetic attraction can be achieved by reduced numbers of the magnet members. The number of the magnet members in the present invention can be reduced by 10% or more in comparison with the weft winder of Japanese Utility Model Laid-Open No. 1-87183.

The present invention has been explained with a disc-shaped magnet, but it should be noted that the shapes and sizes of the magnets and yokes may be modified depending on the weft winder of the weaving machine. The yoke may have any shape as long as it is made of a ferromagnetic material and encircles a periphery of each magnet.

As explained above, the weft winder for a weaving machine of the present invention can show greatly improved efficiency in utilizing the magnetic flux of the magnet, thereby keeping the inner frame member stationary within the stationary outer frame member with a stronger force.

What is claimed is:

1. A weft winder for a weaving machine comprising
(a) a stationary outer frame member constituted by a hollow cylinder made of a non-magnetic material and having an inner conical surface at one end thereof;
(b) a rotor disposed rotatably and concentrically with said stationary outer frame member;
(c) an inner frame member made of a non-magnetic material and rotatably supported by said rotor, said inner frame member having an outer conical surface facing said inner conical surface of said outer frame member via a gap therebetween;
(d) a pipe projecting from an outer end of said rotor and extending in said gap for guiding a weft; and
(e) a plurality of magnet members fixed to said inner conical surface and said outer conical surface, respectively, such that N poles and S poles are circumferentially arranged alternately and that between the magnet members opposing via said gap different magnetic poles are opposing each other to provide magnetic flux to keep the inner frame member stationary within the stationary outer frame member whereby only said rotor is rotatable, wherein each magnet member comprises a plate-shaped magnet having a front surface and a rear surface magnetized in a thickness direction such that a magnetic pole on said front surface facing said gap has a larger magnetic flux density than that of a magnetic pole on said rear surface, and a plate-shaped yoke made of a ferromagnetic material and having a shape encircling a periphery of said magnet, said magnet being fixed to said yoke.

2. The weft winder for a weaving machine according to claim 1, wherein the magnetic flux density of said magnet on said front surface is as large as 1.2 times or more than on said rear surface.

3. The weft winder for a weaving machine according to claim 1, wherein said magnet is made of a rare earth magnet.

4. The weft winder for a weaving machine according to claim 1, wherein at least two magnets adjacent in a circumferential direction are fixed to one yoke.

5. The weft winder for a weaving machine according to claim 1, wherein said yoke is made of magnetic power and a binder resin, and said magnet is integrally attached to said yoke.

* * * * *